US005794755A

United States Patent [19]

Reese et al.

[11] Patent Number: 5,794,755

[45] Date of Patent: Aug. 18, 1998

[54] COIN CHUTE FOR VENDING MACHINE

[75] Inventors: Robert John Reese, St. Charles; George Russell Fink, St. Louis, both of Mo.

[73] Assignee: Crane Co., Stamford, Conn.

[21] Appl. No.: 703,364

[22] Filed: Aug. 26, 1996

[51] Int. Cl.[6] ..... G07F 1/04

[52] U.S. Cl. ..... 194/348

[58] Field of Search ..... 194/347, 348, 194/349

[56] References Cited

U.S. PATENT DOCUMENTS

| | | | |
|---|---|---|---|
| 2,014,505 | 9/1935 | Patche | 194/347 X |
| 4,230,213 | 10/1980 | Spring | 194/348 |
| 4,306,644 | 12/1981 | Rockola et al. | 194/348 |
| 4,346,798 | 8/1982 | Agey, III | 194/348 |
| 5,027,937 | 7/1991 | Parish et al. | 194/348 |
| 5,090,548 | 2/1992 | Hird et al. | 194/345 |
| 5,156,250 | 10/1992 | Parish et al. | 194/348 |
| 5,293,981 | 3/1994 | Abe et al. | 194/345 |
| 5,318,164 | 6/1994 | Barnes et al. | 194/200 |
| 5,392,893 | 2/1995 | Murphy et al. | 194/348 |
| 5,427,220 | 6/1995 | Nishiumi et al. | 194/317 |
| 5,601,177 | 2/1997 | Oden | 194/348 |
| 5,647,470 | 7/1997 | Bruner et al. | 194/347 |

FOREIGN PATENT DOCUMENTS

| | | | |
|---|---|---|---|
| 3345149 | 6/1985 | Germany | 194/348 |

OTHER PUBLICATIONS

Conlux USA Corporation, "Don't Let Salting Stop Sales," 1 page, admitted prior art.

*Primary Examiner*—F. J. Bartuska

*Attorney, Agent, or Firm*—Senniger, Powers, Leavitt & Roedel

[57] ABSTRACT

A coin chute for use with a vending machine for receiving coins and transferring the coins to an electrical coin mechanism and preventing liquid from entering and damaging the electrical coin mechanism. The coin chute includes an upper passage in a first vertical plane for entry of a coin at the upper end thereof, and an intermediate passage extending at an angle away from one side of the upper passage at the lower end of the upper coin passage. The intermediate passage has a side formed by a first grid adapted for passage therethrough of liquid poured into the upper passage. The coin chute further comprises a lower passage extending down from the lower end of the intermediate passage for receiving a coin dropping down through the upper passage and intermediate passage and for delivering it to the electrical coin mechanism. The chute further includes a drain for draining the liquid passing through the first grid. A second grid forms a bottom of the intermediate passage and is adapted for passage of liquid therethrough to the drain in a direction generally perpendicular to the first grid.

14 Claims, 2 Drawing Sheets

14
36
12
34
16
18
50
10
48
46
78
24
49
42
68
44
56
70
64
63
82

3
10
32
68
46
24
12
44
36
66
66
4
4
70
44
46
42
3

42
66

38
66
24
15
32

COIN CHUTE FOR VENDING MACHINE

BRIEF SUMMARY OF THE INVENTION

This invention relates generally to coin operated vending machines and more specifically to coin chutes designed to prevent damage to the vending machines due to vandalism.

Vending machines typically include chutes for receiving coins and directing the coins to an electronic coin mechanism. Coins are normally inserted into a coin slot and travel down along a chute to an electrical coin mechanism which counts and accepts or rejects coins. In an effort to obtain free product and coins, vandals often squirt liquid into the coin chute in an attempt to short the circuit of the electrical coin mechanism. The liquid travels down the coin chute and sprays over the electrical coin mechanism thereby shorting the electrical circuits and damaging the mechanism. The shorting of the electronics may cause a vending machine to "jackpot" or vend one or more times or cause money to be dispensed through the coin return or change mechanism thereby damaging the vending machine and causing financial loss to the owner or lessee of the machine. Existing coin chutes which include a separate path for the coin and liquid typically include a drain passage extending in a single direction for capturing liquid entering the coin chute and may not capture all the liquid entering the chute, especially liquid squirted into the chute at various angles, thus allowing a portion of the liquid entering the chute to reach the electrical coin mechanism.

Accordingly, among the several objects of this invention may be noted the provision of a coin chute for a vending machine which effectively diverts liquid away from the electrical circuit of the vending machine to prevent shorting of the electrical circuit and damage to the coin changer and loss of product or money; the provision of a coin chute that includes multiple flow paths for liquid entering the chute to reduce the possibility of liquid reaching the electrical mechanism; and the provision of a coin chute that is inexpensive to manufacture, requires minimal installation space and is easy to install.

A coin chute of this invention is for use with a vending machine for receiving coins and transferring the coins to an electrical coin mechanism and preventing liquid from entering and damaging the electrical coin mechanism. Generally, the coin chute includes an upper coin passage in a first generally vertical plane for entry of a coin at the upper end thereof. The upper passage is inclined for downward travel of a coin on edge therein. The coin chute further includes an intermediate coin passage extending at an angle away from one side of the upper passage at the lower end of the upper coin passage. The intermediate coin passage is inclined for downward travel of a coin on edge therein and has a side formed by a first grid adapted for passage therethrough of liquid poured into the upper passage. The coin chute further comprises a lower coin passage extending down from the lower end of the intermediate passage for receiving a coin dropping down through the upper passage and intermediate passage and for delivering it to the electrical coin mechanism. The chute further includes a drain for draining the liquid passing through the first grid. A second grid forms a bottom of the intermediate passage and is adapted for passage of liquid therethrough to the drain in a direction generally perpendicular to the first grid.

Other objects and features will be in part apparent and in part pointed out hereinafter.

BRIEF DESCRIPTION OF THE FIGURES

Corresponding parts are designated by corresponding reference numerals in the several views of the drawings.

DESCRIPTION OF THE PREFERRED EMBODIMENT

Figure 1:
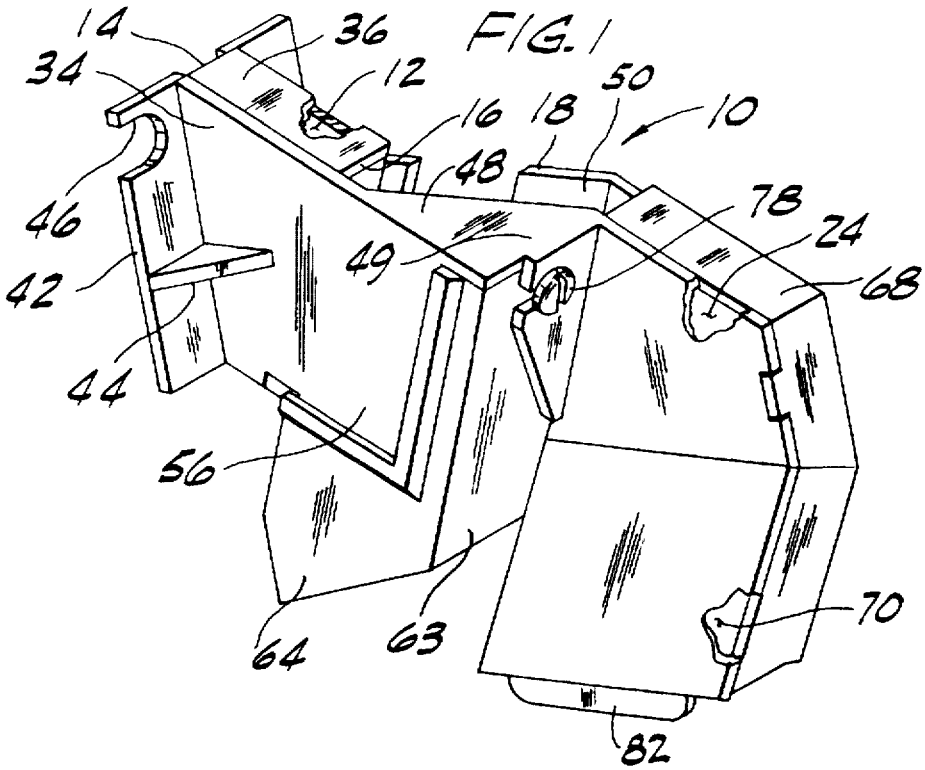
FIG. 1 is a view in perspective of a coin chute of this invention.
Figure 2:
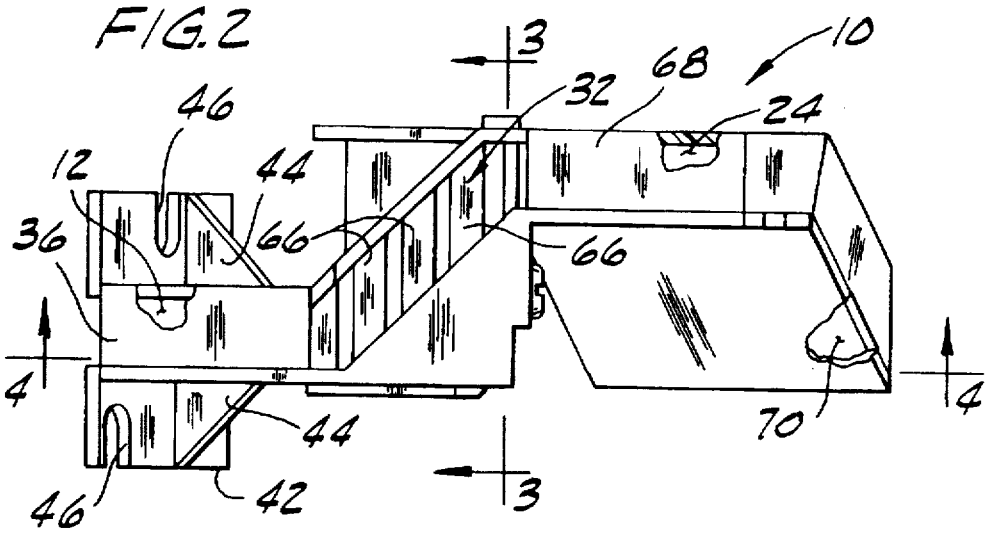
FIG. 2 is a top plan view of the coin chute of FIG. 1.
Figure 5:
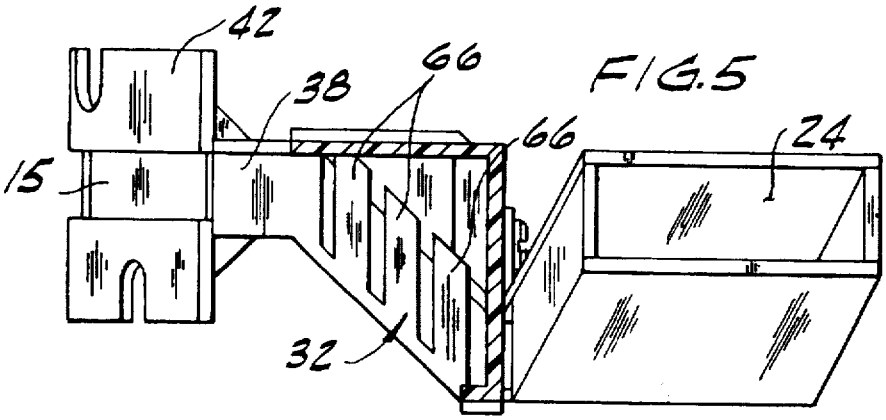
FIG. 5 is a cross-sectional view showing the bottom of the coin chute of FIG. 1.
Figure 3:
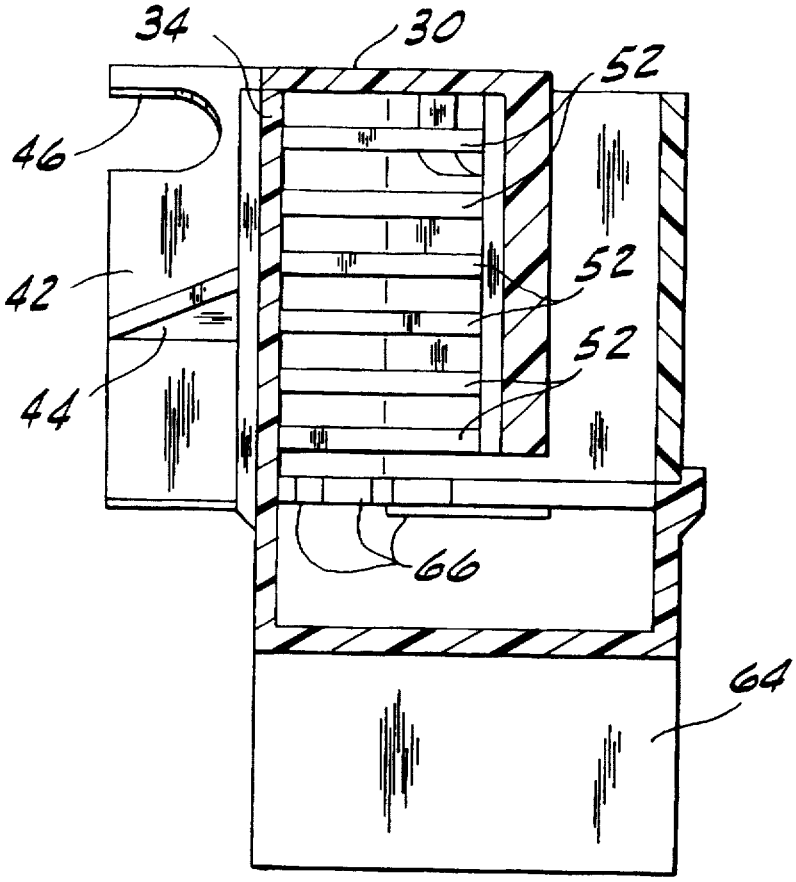
FIG. 3 is a cross-sectional view of the coin chute of FIG. 1 taken in the plane including line 3—3 of FIG. 2.
Figure 4:
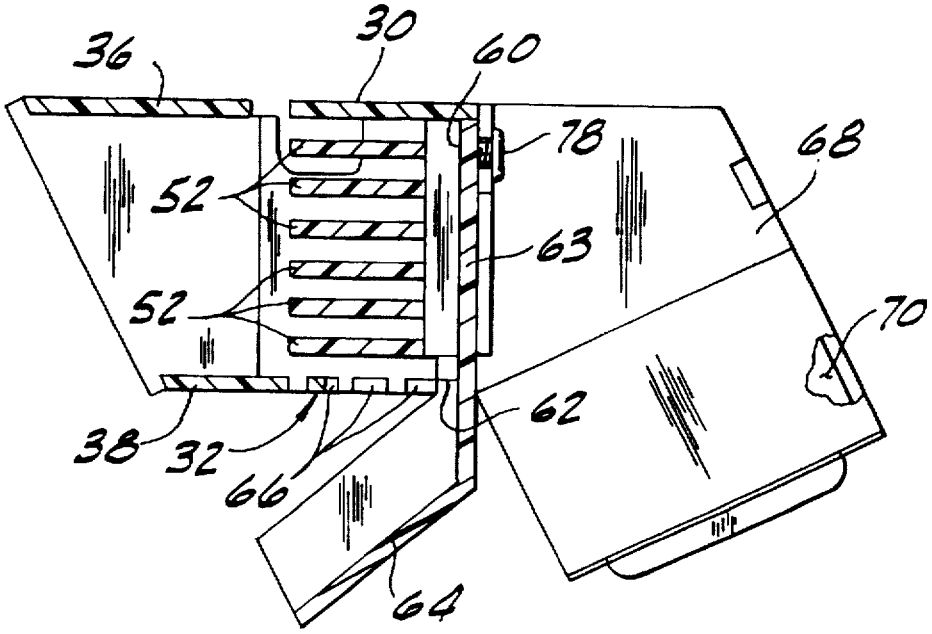
FIG. 4 is a cross-sectional view of the coin chute of FIG. 1 taken in the plane including line 4—4 of FIG. 2.

Referring now to the drawings, and first to FIG. 1, there is generally indicated at 10 a coin chute of this invention for use in any type of vending machine which accepts coins, such as food or beverage machines, for example. The vending machine (not shown) includes a front panel having a coin receiving slot, the coin chute 10 being disposed behind the front panel of the vending machine such that coins entering the slot are received in the coin chute. The chute 10 is mounted on the inside of the door by screws or other typical fastening devices. It receives coins and transfers the coins to an electrical coin mechanism (not shown) which counts the coins and accepts or rejects the coins while preventing liquid from entering and damaging the electrical coin mechanism.

The coin chute 10 includes an upper coin passage 12 in a first generally vertical plane for entry of a coin at the upper end thereof 14, said upper passage being inclined for downward travel of a coin on edge therein, an intermediate coin passage 18 extending at an angle away from one side of the upper passage at the lower end 16 of the upper coin passage, and a lower coin passage 24 extending down from the lower end 26 of the intermediate passage for receiving the coin dropping down through the upper passage and intermediate passage and for delivery of the coin to the electrical coin mechanism. The intermediate passage 18 includes a first grid 30 and a second grid 32 adapted for passage therethrough of liquid poured into the upper passage 12.

The upper coin passage 12 is rectangular and includes two side walls 34 spaced approximately 0.4 in. apart and a top wall 36 and a bottom wall 38 spaced approximately 1.5 in. apart. It is to be understood that these dimensions may vary as long as the passage is sufficiently wide and high to accept coins for use with the vending machine. The upper passage 12 is sized such that the coin is received and passes through the passage on edge and includes an opening 15 for receiving the coins at an upper end thereof and a face plate 42 extending generally perpendicular to the side walls 34 of the upper passage. The face plate 42 extends outward from both side walls 34 of the upper passage 12 and is located at an angle of approximately 70 degrees with respect to the top and bottom walls 36, 38 of the upper passage so that the upper passage is inclined downward with respect to the face plate. The inclined position of the upper passage 12 allows the coin entering the upper passage to travel downward with the force of gravity. Two triangular shaped gussets 44 are provided between the face plate 42 and the side walls 34 of the upper passage 12 for bracing the face plate. The face plate 42 includes a notch 46 extending from the outer edge of each side of the face plate 42 for receiving a screw for attachment of the face plate to an inside surface of the vending machine front panel (not shown). It is to be understood that other types of configurations for attaching the chute to the vending machine may be used without departing from the scope of this invention.

The intermediate passage 18 extends sideways from the lower end 16 of the upper passage 12 at an angle of approximately 65 degrees for directing a coin from the upper passage 12 into the lower passage 24 and for diverting liquid entering the upper passage away from the lower passage. The intermediate passage 18 includes one side wall 50, the first grid 30 parallel to said side wall and the second grid 32 forming the bottom of the passage. Upon entering the intermediate passage 18, the coin contacts the first grid 30 and is directed to the lower passage 24. Liquid squirted into the opening of the upper passage 12 impinges upon the first grid 30. The first grid 30 includes spaced horizontal bars 52 for passage of liquid therebetween to a liquid drain 60 behind the first grid. The drain 60 is defined by a solid rear wall 63 spaced from the first grid 30 and a top wall 49 extending beyond the top wall 48 of the first grid. The drain 60 has an open bottom 62 from which the liquid exits and drains into a drainage channel 64 extending downward at an angle below the intermediate passage 18. The drainage channel 64 is generally U-shaped with an open top for directing liquid entering from the intermediate passage 18 to an area either internal or external to the vending machine to keep the liquid away from the electrical coin mechanism.

The second grid 32 is adapted for downward passage of liquid therethrough in a direction generally perpendicular to the first grid 30. The second grid 32 constitutes the bottom of the intermediate passage 18 to receive any liquid which does not enter the first grid 30. For example, liquid poured into the opening of the upper passage 12 rather than squirted into the passage is more likely to flow through the second grid 32. The two grids 30, 32 significantly reduce the possibility of liquid passing through the intermediate coin passage 18 and entering the lower coin passage 24. The drainage channel 64 is located directly below the second grid 32 so that liquid entering the second grid flows into the drainage channel and is directed away from the electrical coin mechanism. The second grid 32 is formed with horizontal bars 66 extending across the width of the intermediate passage 18, being located adjacent the bottom opening 62 of the drain 60. The horizontal bars 66 do not extend into the opening of the drain 60. It is to be understood that both the first and second grids 30, 32 can have configurations other than those described above without departing from the scope of the invention. For example, the grids could be formed with circular or any other suitably shaped openings.

The lower coin passage 24 includes a first portion 68 extending from the intermediate passage and a second portion 70 extending from the first portion and directing the coins to the electrical coin mechanism. The first portion 68 of the lower passage 24 is located in a second plane laterally offset from a first plane in which the upper passage 12 is located. The second portion 70 of the lower passage 24 is angled at approximately 70 degrees with respect to the first portion 68. The coin slides through the second portion 70 of the lower passage 24 on one face of the coin. It is to be understood that the lower passage 24 can have various configurations to direct the coins to a specific location with different vending machine designs. The lower coin passage 24 is generally rectangular shaped and has a width and height similar to the upper and intermediate coin passages 18, 24. A diverter 82 extends from the lower end of the lower passage 24 for directing the coin to the electrical coin mechanism. The diverter 82 is configured such that it can be broken off if required to interface with various configuration vending machines.

The coin chute 10 is preferably made from a polymeric material to provide a lightweight low cost design. The chute may also be formed of metal or any other suitable material. The chute is made up of three interlocking pieces 72, 74, 76, two of the pieces 72, 74 making up the majority of the chute. The two major portions each generally form one side of the chute and are bonded together by adhesive or other suitable bonding methods. The third piece 76 forms the back wall 63 of the drain 60 and is attached to one of the other pieces by a screw 78 or any other suitable connector. The chute may also be formed integrally as one piece or by a larger number of smaller pieces.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed:

1. A coin chute for use with a vending machine for receiving coins and transferring the coins to an electrical coin mechanism and preventing liquid from entering and damaging the electrical coin mechanism, the coin chute comprising:

an upper coin passage in a first generally vertical plane for entry of a coin at the upper end thereof, said upper passage being inclined for downward travel of a coin on edge therein and having a coin outlet at a lower end thereof;

an intermediate coin passage extending at an angle away from one side of the upper passage at the lower end of the upper coin passage, said intermediate coin passage being inclined for downward travel of a coin on edge therein and having a side formed by a first grid extending for at least the entire area of the upper coin passage outlet and adapted for passage therethrough of liquid poured into the upper passage;

a lower coin passage extending down from the lower end of the intermediate passage for receiving a coin dropping down through the upper passage and intermediate passage and for delivery to the electrical coin mechanism, at least a portion of the lower coin passage being in a second plane laterally offset from the first plane;

a drain for draining off liquid passing through the first grid; and a second grid forming a bottom of the intermediate passage and adapted for passage of liquid therethrough to said drain in a direction generally perpendicular to the first grid.

2. A coin chute as set forth in claim 1 wherein said second grid is located generally adjacent the bottom of the first grid.

3. A coin chute as set forth in claim 1 wherein the drain is formed to collect liquid draining from said first grid and said second grid and diverting the liquid away from the electrical coin mechanism.

4. A coin chute as set forth in claim 1 wherein said coin chute includes three interlocking pieces.

5. A coin chute as set forth in claim 4 wherein two pieces are bonded together and further comprising at least one connector for connecting the third piece to one of the other two pieces.

6. A coin chute as set forth in claim 1 wherein said coin chute is formed from a polymeric material.

7. A coin chute as set forth in claim 1 wherein said first grid comprises a plurality of spaced horizontal bars extending from substantially the top to the bottom of the side wall.

8. A coin chute as set forth in claim 1 wherein said lower passage includes a first portion and a second portion, said second portion being angled from said first portion and providing an outlet opening substantially in said first plane for the passage of coins.

9. A coin chute as set forth in claim 1 wherein said first grid has a length at least equal to a diameter of the largest coin being received in the coin chute.

10. A coin chute as set forth in claim 1 further comprising a front face located at the upper end of the upper passage for attaching the coin chute to the vending machine.

11. A coin chute as set forth in claim 1 wherein said second grid comprises a plurality of generally horizontal bars.

12. A coin chute as set forth in claim 1 further comprising a diverter extending from the lower end of the lower passage for directing the coin to the electrical coin mechanism.

13. A coin chute as set forth in claim 12 wherein said diverter is configured such that it can be broken off to permit said coin chute to interface with different vending machines.

14. A coin chute as set forth in claim 1, including:

the drain having a solid rear wall disposed spaced from and behind the first grid for receiving and diverting downwardly liquid which impinges thereon, the drain further including a channel portion for receiving liquid from between the solid rear wall and the first grid and from the second grid and directing the liquid away from the electrical coin mechanism.

* * * * *